US009366200B2

(12) United States Patent
Knob

(10) Patent No.: US 9,366,200 B2
(45) Date of Patent: Jun. 14, 2016

(54) SEAL ASSEMBLY FOR ROTARY-PISTON INTERNAL-COMBUSTION ENGINE

(71) Applicant: Václav Knob, Praha (CS)

(72) Inventor: Václav Knob, Praha (CS)

(73) Assignee: KNOB ENGINES S.R.O., Celakovice (CZ)

( * ) Notice: Subject to any disclaimer, the term of this patent is extended or adjusted under 35 U.S.C. 154(b) by 0 days.

(21) Appl. No.: 14/405,605

(22) PCT Filed: Jun. 17, 2013

(86) PCT No.: PCT/CZ2013/000077
§ 371 (c)(1),
(2) Date: Dec. 4, 2014

(87) PCT Pub. No.: WO2013/189471
PCT Pub. Date: Dec. 27, 2013

(65) Prior Publication Data

US 2015/0144092 A1 May 28, 2015

(30) Foreign Application Priority Data

Jun. 21, 2012 (CS) ..... PV 2012-422

(51) Int. Cl.
*F01B 13/04* (2006.01)
*F02B 57/08* (2006.01)
(Continued)

(52) U.S. Cl.
CPC ..... *F02F 11/007* (2013.01); *F01B 13/068* (2013.01); *F02B 57/00* (2013.01); *F02B 57/08* (2013.01); *F02B 59/00* (2013.01); *F02F 1/18* (2013.01)

(58) Field of Classification Search
CPC ..... F02F 11/007; F02F 1/18; F02B 59/00; F02B 57/00; F02B 57/08; F01B 13/068; F16J 9/00; F16J 9/06; F16J 9/061; F16J 9/12
USPC ..... 123/44 R, 45 R, 43 R, 43 C, 44 D, 44 E; 91/176, 197, 472; 92/54, 58; 277/357; 418/142
See application file for complete search history.

(56) References Cited

U.S. PATENT DOCUMENTS 3,665,811 A 5/1972 Van Avermaete
3,885,897 A * 5/1975 Huf ..... F01C 21/04 418/129

(Continued)

FOREIGN PATENT DOCUMENTS

DE 2153946 A 5/1973
DE 2732779 A1 2/1979

(Continued)

*Primary Examiner* — Kenneth Bomberg
*Assistant Examiner* — Jason T Newton
(74) *Attorney, Agent, or Firm* — Andrew Wilford

(57) ABSTRACT

The invention relates to seal assembly for a rotary piston internal combustion engine comprising a rotating block (11) of a rotational shape with radially situated cylinders (12) with pistons (13) and an outer stationary case (10) with at least one intake port (14) and/or exhaust port (15). The outer surface (16) of the rotating block (11) is a rotational surface with a straight line or curved profile curve, on which transverse and/or side sealing parts, which are placed in the stationary case (10), sit. In circular side grooves (2) there is a side seal consisting of circular side sealing segments (1) that are always placed between neighboring transverse sealing strips (3), which are placed in transverse grooves (4). Those sealing strips (3) go through the side grooves (2) across. In the place, where the side sealing segments (1) and transverse sealing strips (3) meet, there are joints (5) with notches (7) for inserting the side sealing segments (1) and transverse sealing strips (3).

5 Claims, 3 Drawing Sheets

(51) Int. Cl.

| | |
|---|---|
| ***F02B 57/10*** | (2006.01) |
| ***F02F 11/00*** | (2006.01) |
| ***F01B 13/06*** | (2006.01) |
| ***F02B 57/00*** | (2006.01) |
| ***F02B 59/00*** | (2006.01) |
| ***F02F 1/18*** | (2006.01) |

(56) References Cited

U.S. PATENT DOCUMENTS 3,909,164 A * 9/1975 Fritzsche ..... F01C 21/106 418/125
3,930,767 A * 1/1976 Hart ..... F01C 19/10 418/113
3,995,599 A * 12/1976 Shier ..... F02B 47/08 123/203
4,010,719 A 3/1977 Lappa
4,029,444 A * 6/1977 Clarke ..... F01C 19/00 418/120
6,883,473 B2 4/2005 Wondergem
6,928,965 B2 * 8/2005 Teufl ..... F01B 13/045 123/18 R
2004/0261731 A1 12/2004 Fathollahi

FOREIGN PATENT DOCUMENTS

| | | | |
|---|---|---|---|
| DE | 3417342 | A | 11/1985 |
| FR | 2243608 | A | 4/1975 |
| GB | 275740 | A | 8/1927 |
| WO | 9857036 | A | 12/1998 |

* cited by examiner

SEAL ASSEMBLY FOR ROTARY-PISTON INTERNAL-COMBUSTION ENGINE

CROSS REFERENCE TO RELATED APPLICATIONS

This application is the US-national stage of PCT application PCT/CZ2013/000077 filed 17 Jun. 2013 and claiming the priority of Romanian patent application PV2012-422 itself filed 21 Jun. 2012.

TECHNICAL FIELD

The invention relates to embodiment of seal for an internal combustion engine that comprises a rotating block of a rotational shape, with radially situated cylinders with pistons. Outside the rotating cylinder block there is a stationary case with at least one intake and/or exhaust port. The rotating cylinder block together with the stationary case work like a rotary valve.

BACKGROUND OF THE INVENTION

There have been designed many engines with a rotating block of a rotational shape with radially situated cylinders with pistons and an outer stationary case with an intake and/or exhaust port. The rotating cylinder block together with the stationary case work like a rotary valve. There are well known designs of two-stroke as well as four-stroke engines, two, three and multi-cylinder arrangements. Some engines have been equipped with the crankshaft mechanism and some have been equipped with other known mechanisms for transferring the motion of the piston to the shaft. None of those designs has achieved wider enlargement and utilization despite the undoubted potential. There are many reasons why these engines were not successful. The main reason is that the seal between the rotating block and the stationary case was not optimally designed. Mostly, the seal between cylinder space and the stationary case was done by means of sealing elements that were placed in the rotating cylinder block. Those sealing elements were then exposed to centrifugal forces that result from rotation of the rotating block. Together with increasing revolutions that leads to significant stress of these sealing elements, to high friction losses and lubrication problems.

Such designs are described e.g. in documents DE 2732779, FR 2767156A1.

There have been also designs with a seal that is placed in the stationary case of the engine. The most simple is a seal in the form of rings that are placed on both sides of the perimeter of the rotating block. Another seal is done by transverse sealing strips that are placed in the stationary case in the transverse direction with respect to the motion of the perimeter of the rotating block. Such designs are described e.g. in documents FR 2639676A1, U.S. Pat. No. 1,705,130A, W0 9823850A1, W0 8302642A1, etc. This solution is advantageous due to absence of centrifugal forces that act on the sealing parts. Due to minimizing volume of interstices in the combustion space it is necessary to place the side sealing rings as close to cylinder bores as possible. If the side sealing parts are too close to the cylinder bore, then the transverse sealing strips extend too little beyond the cylinder bore, when these cylinder bores are passing these sealing strips. That would increase wear and decrease tightness and durability of the sealing strips. Due to the total length of the seal of the space with high pressure it is necessary to achieve as perfect sealing as possible. Untightness in the place, where the sealing strips and rings meet, is a problem. Gas can blow by through both clearance between sealing parts and particularly at the bottom of their connected grooves. If there is more than one side sealing ring, gas that overcomes the first ring can further blow through the circumferential interstice between side rings.

SUMMARY OF THE INVENTION

Above mentioned deficiencies are removed to a large extent by seal assembly for the rotary piston internal combustion engine comprising a rotating block of a rotational shape with radially situated cylinders with pistons and an outer stationary case with at least one intake port and/or exhaust port, while the outer surface of the rotating block is a rotational surface with a straight line profile curve or a curved line profile curve, on which the transverse and/or side seals, which are placed in the stationary case, sit down, according to this invention. The essence is that in the circular side grooves there is a side seal that consists of circular side sealing segments that are always located between neighboring transverse sealing strips that are placed in transverse grooves. Those sealing strips go through the side grooves across. In the place where the side sealing segments and transverse sealing strips meet there are joints with notches for inserting the side sealing segments and transverse sealing strips.

Those joints are advantageously placed in bores in the outer stationary case. The cross-section of the joints is in the shape of an n-polyhedron, where n ranges between 3 and $\propto$, i.e. the cross-section can be in the shape of a polyhedron, circle or oval, etc. There are springs between the joints and the stationary case. The joints simultaneously sit down to side sealing segments and/or transverse sealing strips by their bottom of notches and that ensures pressing these seals down to the surface of the rotating block. Side sealing segments and/or transverse sealing strips are advantageously equipped with more springs that are placed in the side grooves and/or transverse grooves in the stationary case.

Side sealing segments are advantageously in at least two rows next to each other in at least two side grooves, while the nearest row of the side sealing segments is placed in close proximity of cylinder bores that are in the rotating block.

The joint is advantageously placed in the place, where at least one transverse strip and at least two side sealing segments meet.

The transverse sealing strip has advantageously a chamfer on the seating surface. That chamfer is oriented in the way that it is on the opposite side of the spark plug.

Seal assembly for the rotary piston internal combustion engine enables effective sealing between the rotating block and the stationary case. Placement of the sealing elements in the stationary case ensures that the pressure force of the sealing elements is independent on the engine speed and that allows reaching high engine speed and thus high specific parameters. All transverse sealing strips and side sealing segments have a planar contact with the rotational outer surface of the rotating block. That decreases demands on the sealing elements material and quality of the outer surface area of the rotating block. Planar contact of the sealing elements also decreases demands on lubrication of sealing elements and increases their efficiency and durability. The main advantage is that the transverse sealing strips can be long and extend sufficiently on both sides over the widest point of the cylinder bore in the rotating block, when the cylinder bore passes the transverse strip. At the same time it is possible to place side sealing segments close to cylinder bores in the rotating block and thus minimize the space of interstice between the rotating block and stationary case. Sealing the space with high cylinder pressure between the rotating block and the stationary case can be done by multiple seals in both transverse and side direction, which ensures high level of sealing.

Sealing joints are also important, because they ensure seal of clearances between transverse sealing strips and side sealing segments. If the joint sits down on the transverse sealing strip or on the side sealing segment by its bottom of notches, so it closes the clearance at the bottom of the notch and prevents gas blowing through clearances at the bottom of the transverse groove and side groove.

Suitable shape of the transverse strip profile can utilize cylinder pressure to increase pressure force that presses the strip to the rotating block. When the cylinder pressure decreases or when the cylinder bore passes the transverse strip, load of the transverse sealing strip is reduced, which leads to lower friction losses and wear.

Joints can be seated in bores in the outer stationary case and those bores are easy to manufacture in any phase of engine manufacturing. The joints can have various cross-sectional shapes, from a triangle to a circle. Springs between joints and the stationary case ensure sufficient pressure force that presses the sealing segments and/or transverse sealing strips to the outer surface of the rotating block. The pressure force is created also by other springs. The chamfer on the transverse sealing strip is oriented in the way that it is on the opposite side of the spark plug. That ensures better seating and guiding of the sealing strip.

Using this seal assembly in a rotary piston internal combustion engine enables realization of a simple, production-cheap engine of small dimensions, with small number of moving parts, with balanced, silent working and high specific parameters.

BRIEF DESCRIPTION OF THE DRAWINGS

Seal assembly for a rotary piston internal combustion engine according to the invention will be closer clarified on model embodiment by means of enclosed drawings. In the FIG. 1 there is an axonometric view of the seal assembly with a half of the stationary case and the rotating block with cylinders and pistons. The cylinder block with pistons is axially moved from the outer stationary case for better illustration.

DETAILED DESCRIPTION OF THE INVENTION

Figure 1:
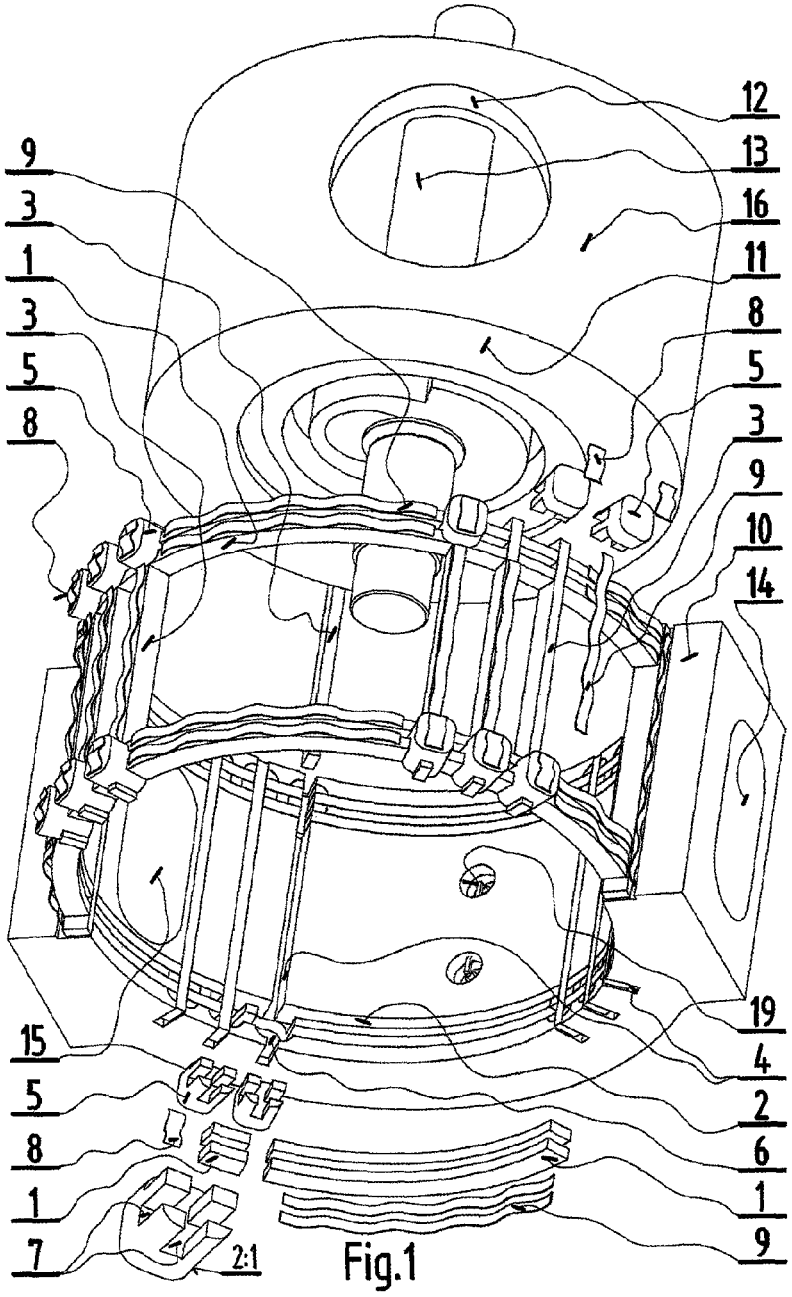

Model seal for a rotary piston internal combustion engine according to the FIG. 1 comprises circular side sealing segments 1, transverse sealing strips 3, joints 5, springs 8 and other springs 9. All these parts are placed in a stationary case 10, in which a rotating block 11 with radially situated cylinders 12 and pistons 13 is placed. Its outer surface 16 is a rotational cylindrical surface. The stationary case 10 is provided with an intake port 14 and exhaust port 15. Side sealing segments 1 are placed in two rows in circular side grooves 2. Springs 8 and joints 5 are placed in bores 6. Transverse sealing strips 3 are placed in transverse grooves 4 and other springs 9 are placed in transverse grooves 4 and side grooves 2. Between the spark plug 19 and both the intake port 14 and exhaust port 15 there are three transverse strips 3. Joints 5 are provided with notches 7, which side sealing segments 1 and transverse sealing strips 3 reach. The joint 5 connects always one transverse sealing strip 3 and four side sealing segments 1.

Figure 2:
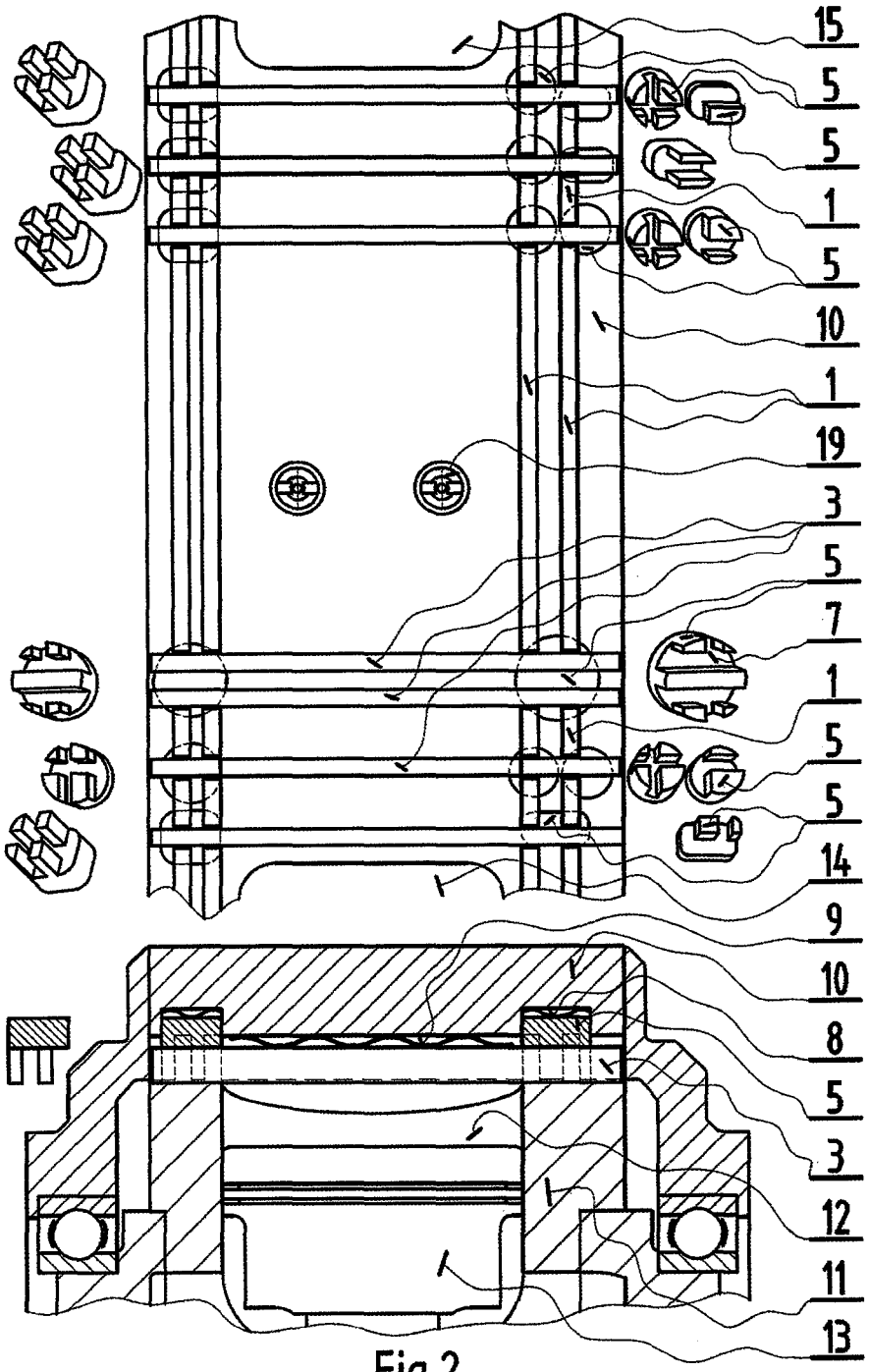
FIG. 2 is an unfolded view of the inner surface of the stationary case and also a cross-sectional view of the rotating block taken longitudinally through the axis of rotation.

Embodiment of seal assembly for a rotary piston internal combustion engine according to FIG. 2 follows the embodiment according to FIG. 1. The difference is in use of different joints 5. They have different shapes and forms of the notches 7. Some connect one transverse strip 3 with four side sealing segments 1. Some connect one transverse strip 3 with only two side sealing segments 1 and some connect two transverse strips 3 with four side sealing segments 1.

Figure 3:
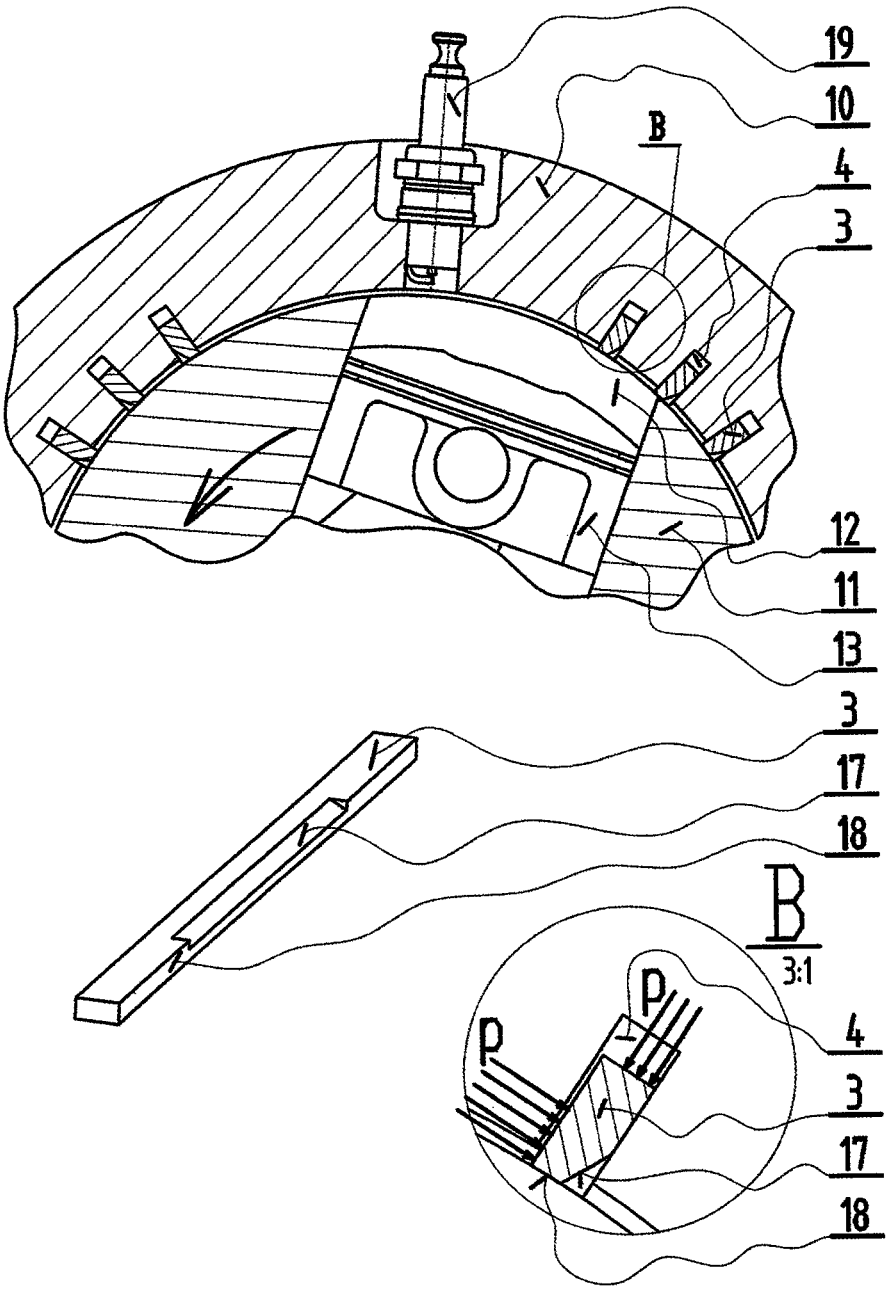
FIG. 3 schematically shows a cross-sectional view of the rotary piston engine taken perpendicularly to the axis of rotation, where the transverse sealing strips with chamfers are pictured.

Embodiment of seal assembly for a rotary piston internal combustion engine according to FIG. 3 follows the embodiment according to FIG. 1. Transverse sealing strips 3 have a chamfer 17 on their seating surface 18. The chamfer is oriented in the way that it is on the opposite side of the spark plug 19.

The function of seal assembly for a rotary piston internal combustion engine is following. Springs 8 press joints 5 to the outer surface 16 of the rotating block 11. The joints 5 can sit down onto side sealing segments 1 and/or onto transverse sealing strips 3 by bottoms of their notches 7. The pressure force of springs 8 is then transferred also on the side sealing segments 1 and/or on transverse sealing strips 3 and they are pressed to the outer surface 16 of the rotating block 11. Side sealing segments 1 and/or transverse sealing strips 3 can be also pressed to the outer surface 16 of the rotating block 11 by other springs 9. As the rotating block 11 rotates in the stationary case 10, the cylinder bore 12 stepwise passes all transverse sealing strips 3, which extend the cylinder bore 12 sufficiently on both sides and there is no danger in their damage. At the ignition time there are advantageously more transverse strips 3 between the cylinder bore 12 and the intake port 14 and/or exhaust port 15. They ensure fine sealing of the cylinder space 12. Sealing is also improved by placing the side sealing segments 1 in more rows next to each other. Joints 5 can connect more side sealing segments 1 with one or more transverse strips 3. Transverse strips 3 can have a chamfer 17 on the seating surface 18, which is oriented in the way that it is on the opposite side of spark plugs 19. Cylinder pressure 12 creates then additional pressure force acting on transverse strips 3 and that further improves their tightness.

INDUSTRIAL APPLICABILITY

Seal assembly for a rotary internal combustion engine according to the invention can be used for instance in aircraft engines, motorcycle engines, racing car engines and other applications of rotary piston engines, where high performance at low weight and small dimensions are of high priority. Thanks to their simplicity and small dimensions, rotary piston engines equipped with seal assembly according to the invention can be also used as propulsion of garden equipment, standby generators, etc. Provided that the lubricating oil consumption is significantly limited it is possible to consider application in conventional vehicles, for instance as a range extender for electric vehicles.

The invention claimed is:

1. A rotary piston internal combustion engine comprising:

a rotating block centered on an axis and with radially extending cylinders;

respective pistons in the cylinders;

an external stationary case with at least one intake port and exhaust port, an outer surface of the rotating block being a surface of revolution with a straight or curved profile curve and formed with transverse circular side grooves;

transverse or side sealing parts in the stationary case and bearing radially inward on the outer surface of the block;

respective side seals in the circular side grooves and consisting of circular side sealing segments that are always placed between neighboring transverse sealing strips that are in respective transverse grooves, and these sealing strips extending through the side grooves;

respective joints where the side sealing segments and the transverse sealing strips meet and formed with notches for the side sealing segments and transverse sealing strips, the joints each having a cross-section in the shape of an n-polyhedron, where n ranges between 3 and $\propto$; and springs between the joints and the stationary case, the joints simultaneously extend down to the side sealing segments or transverse sealing strips at floors of their notches to press the sealing strips against the outer surface of the rotating block.

2. The rotary piston internal combustion engine according to claim 1 wherein case is formed with bores holding the joints.

3. The rotary engine according to claim 1, wherein the side sealing segments or transverse sealing strips are equipped with other springs set in the side grooves or in the transverse grooves in the stationary case.

4. The rotary engine according to claim 1, wherein the side sealing segments are at least in two rows next to each other in at least two of the side grooves, the nearest row of the sealing segments being close to cylinders of the rotating block.

5. The rotary engine according to claim 1, wherein each joint is a respective one of the transverse strips and at least two respective side sealing segments.

* * * * *